US005675114A

United States Patent [19]

Thebault et al.

[11] Patent Number: 5,675,114

[45] Date of Patent: Oct. 7, 1997

[54] METHOD AND DEVICE FOR LOADING OF AN ARTILLERY GUN

[75] Inventors: Didier Thebault, Bourges; Laurent Legrand, Mehun/Yevre; Jean-Patrick Simon, Bourges, all of France

[73] Assignee: Giat Industries, Versailles, France

[21] Appl. No.: 597,200

[22] Filed: Feb. 6, 1996

[30] Foreign Application Priority Data

Feb. 16, 1995 [FR] France ..... 95 01781

[51] Int. Cl.[6] ..... F41A 9/00

[52] U.S. Cl. ..... 89/45; 89/47

[58] Field of Search ..... 89/45, 47, 33.01, 89/34

[56] References Cited

U.S. PATENT DOCUMENTS

| | | | |
|---|---|---|---|
| 311,974 | 2/1885 | Gatling | 89/45 |
| 932,094 | 8/1909 | Becker | 89/45 |
| 5,048,393 | 9/1991 | Grabner et al. | 89/45 |

FOREIGN PATENT DOCUMENTS

| | | |
|---|---|---|
| 419 762 | 4/1991 | European Pat. Off. . |
| 1 578 083 | 8/1970 | Germany . |
| 39 40 421 | 6/1991 | Germany . |
| 308025 | 3/1929 | United Kingdom . |

*Primary Examiner*—J. Woodrow Eldred
*Attorney, Agent, or Firm*—Oliff & Berridge

[57] ABSTRACT

A device assists in the loading and/or unloading of a field artillery gun using cylindrical uni-modular charges or powder bags. The loading/unloading device includes an implement to carry the charges into the chamber of the gun, and to release the charges before firing. A method for loading/unloading a field artillery gun includes placing the charges on an implement; and inserting the implement into the chamber along with the charges to position the charges within the chamber before firing.

10 Claims, 4 Drawing Sheets

METHOD AND DEVICE FOR LOADING OF AN ARTILLERY GUN

BACKGROUND OF THE INVENTION

The technical scope of the present that of devices to assist in the hand loading of an artillery gun.

An artillery gun is conventionally manned by a crew responsible to load the gun so as to ensure a firing rate of 3 to 6 rounds per minute. This requires the handling of the projectiles and their propellant charges and their loading into the gun. The artillery gun is already fitted with a loading mechanism which in particular makes it easier to position the projectile, usually heavy, in the gun chamber. In addition to convention powder bags, uni-modular charges are also being used which are formed of cylindrical modules of the same length, the range of the projectile being adjusted by acting on the number of modules. It is well known that the use of modules enables the propellant charge to be better managed and avoids the wastage which can occur when powder bags are used, but raises the problem of their introduction into the gun chamber especially if the firing rate is to be increased.

The American army has adopted a loading assistance device formed of a set of clips fastened onto a single support, thus enabling each module to be grasped. The system is both complicated and unreliable as it requires the simultaneous opening of all the clips whatever the operational conditions, which are generally harsh for this type of gun. This system is therefore not easy to implement and, more importantly, is not reversable, in other words, it does not allow the gun to be unloaded in the event of a misfire.

The German army recognizes the use of stackable modules, nesting one in the other, thereby avoiding the use of a loading assistance device but which present the disadvantage of having to be positioned in order to be fitted together. It seems to us that this method is not really compatible with operational conditions for a field artillery gun and restricts the firing rate.

SUMMARY OF THE INVENTION

One aim of the present invention is to supply a loading assistance device, which does not have the above disadvantages but which allows a high rate of fire, for the loading and unloading of modules whatever the type of chamber or type of conventional powder bags.

The subject of the invention is thus a device to assist the loading or unloading of a field artillery gun using uni-modular charges or powder bags, characterised in that it is formed of an implement to receive the charges, of which there are, for example, between 1 and 6, an implement which can be activated by hand and which is able to engage in the gun chamber and release the charges before firing.

According to another characteristic of the invention, the charges may be released by the receiving implement which rotates with respect to the gun chamber, the receiving implement being in the form of a semi-cylindrical chute fitted at one end with structure to position the charges and an operating handle.

By way of an example, the chute may be made of a composite material formed of glass fibers coated with epoxy resin reinforced with a conductive material such as a metallic matrix or metallized micro-pellets to enable the evacuation of electrostatic charges.

According to another characteristic of the invention, the positioning structure is in the form of an inner wall integrated into the chute, the chute being fitted with an outer wall fitted with the operating handle.

A first advantage of the device according to the invention lies in its simplicity to produce allowing it to be used autonomously whatever the operational conditions of the field gun.

Another advantage lies in the low bulk and mass, in the region of 1.5 kg, of this device which can be used with gun chambers of different sizes.

BRIEF DESCRIPTION OF THE DRAWINGS

Other characteristics and advantages of the invention will become apparent from reading the additional description hereafter, given by way of illustration with reference to the appended drawings in which.

DETAILED DESCRIPTION OF PREFERRED EMBODIMENTS

Figure 1:
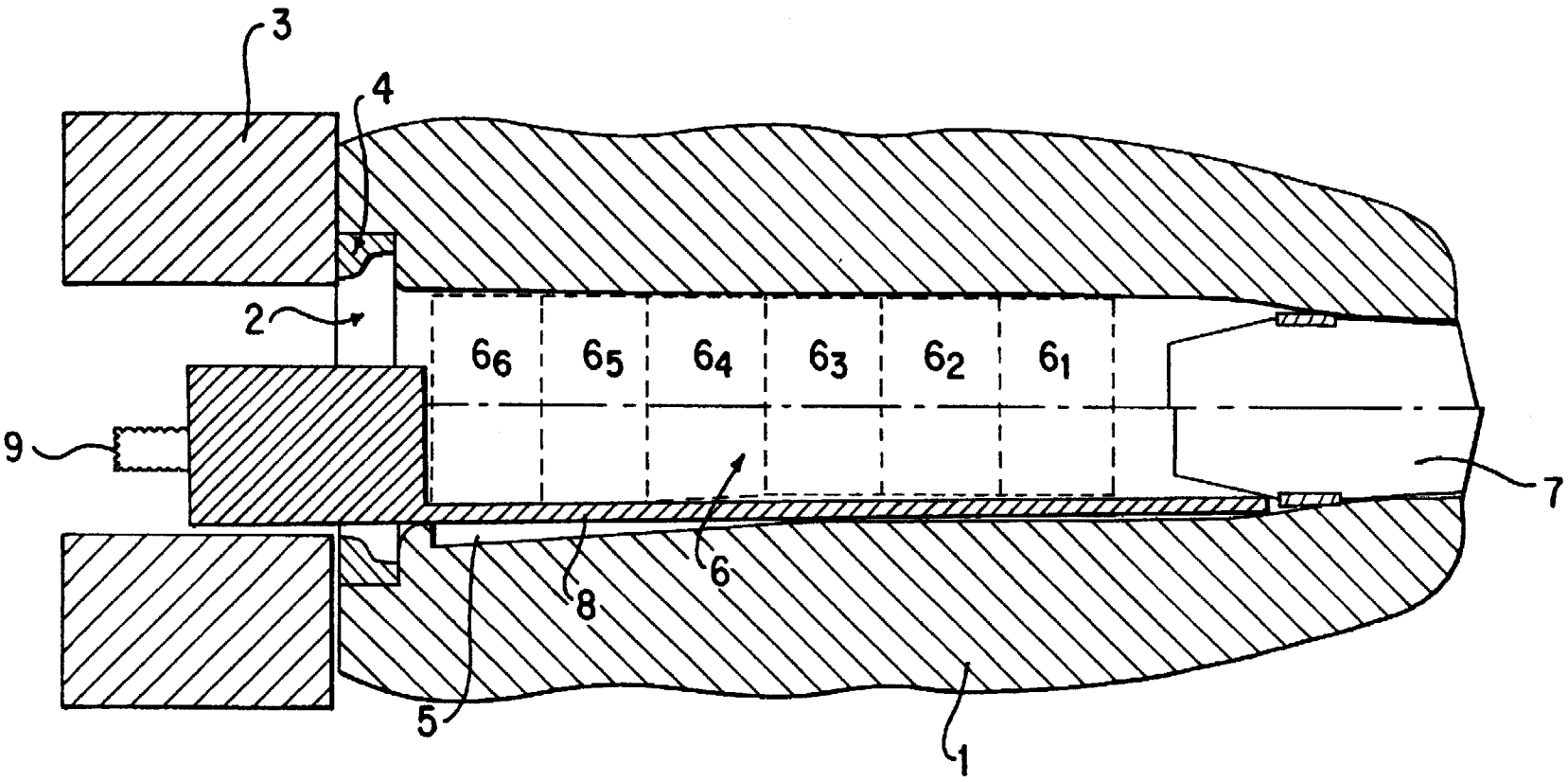
FIG. 1 is a skeleton section view showing the modules being introduced in the gun chamber using the loading assistance device.

The device according to the invention enables, as described above, the loading of an artillery gun 1 which has a chamber 2 extended by a breech ring 3. A sealing ring 4 is conventionally placed between the chamber 2 and the breech ring 3, and the chamber is conventionally closed by means of a breech block (not shown). The chamber is also fitted with a lever 5 to retain the charge 6, which is composed of one to six cylindrical modules 61–66. The charge, after firing, generates gases to propel the projectile 7 in the barrel 1. According to the invention, the modules of the charge 6 are introduced into the chamber 2 using a loading assistance device formed of a receiving implement 8 which can be operated by hand using a handle 9. The length of the receiving implement 8 is adjusted according to the length of the chamber 2 and it can be arranged such that, for example, the free end of the receiving implement is stopped against the projectile and that the module 66 is positioned roughly level with the retaining lever 5.

Figure 2:
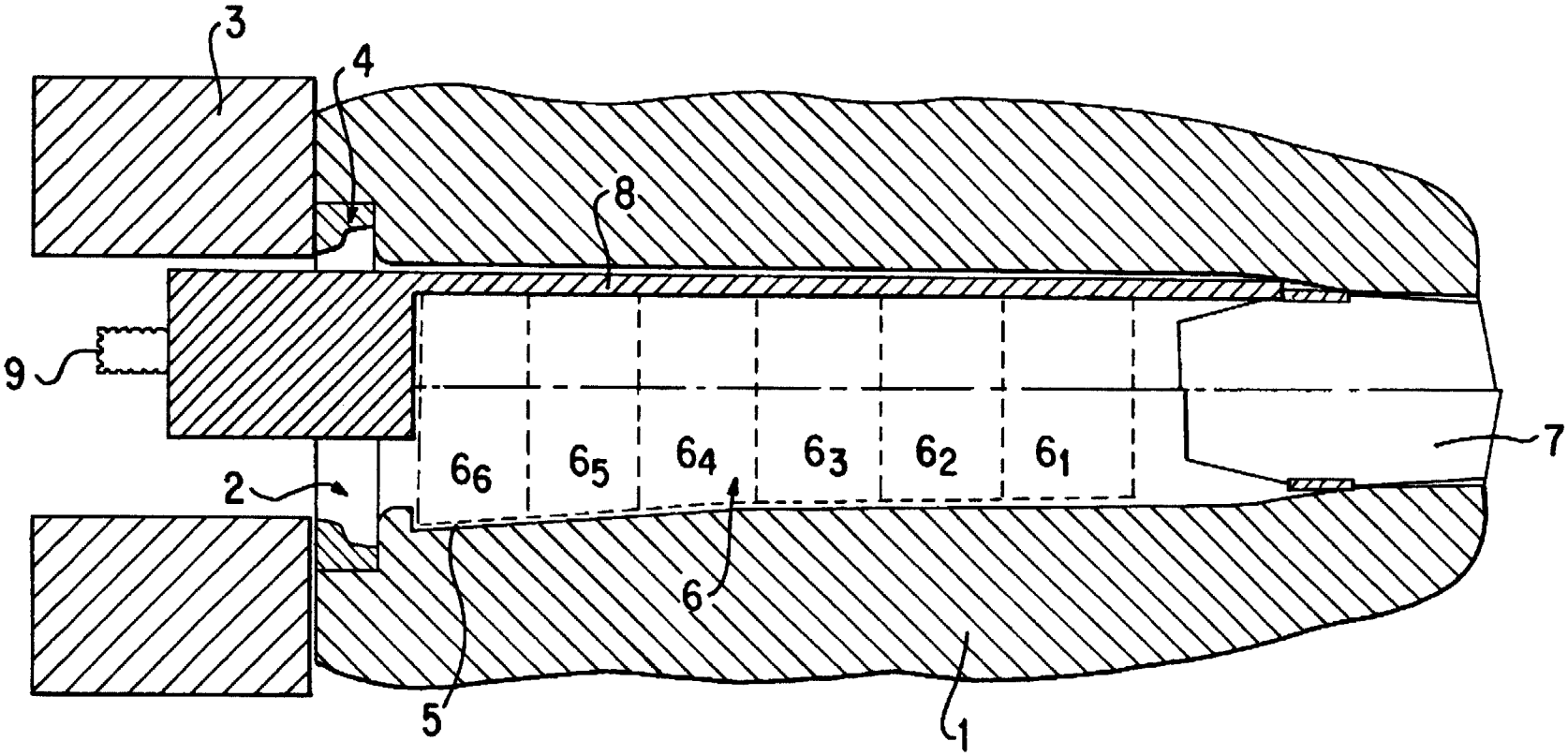
FIG. 2 is a skeleton section view showing the modules being released.

After the implement 8 has been set in place, it is made to swivel 180° with respect to the chamber 2, as shown in FIG. 2. The modules 61–66 then lie in the chamber 2. The implement 8 is thereafter extracted from the chamber and during this movement, the charge 6 is likewise moved by friction with the said implement 8 and the module 66 comes to rest upon the retaining lever 5 and the charge 6 can be fired.

If the chamber 2 is required to be unloaded, for example after a misfire, the reverse procedure is followed in order to recover the modules. The implement 8 is introduced into the chamber 2 as shown in drawing form in FIG. 2; it is made to rotate 180° to bring it into the position shown in FIG. 1; the charge 6 is then extracted.

Figure 3:
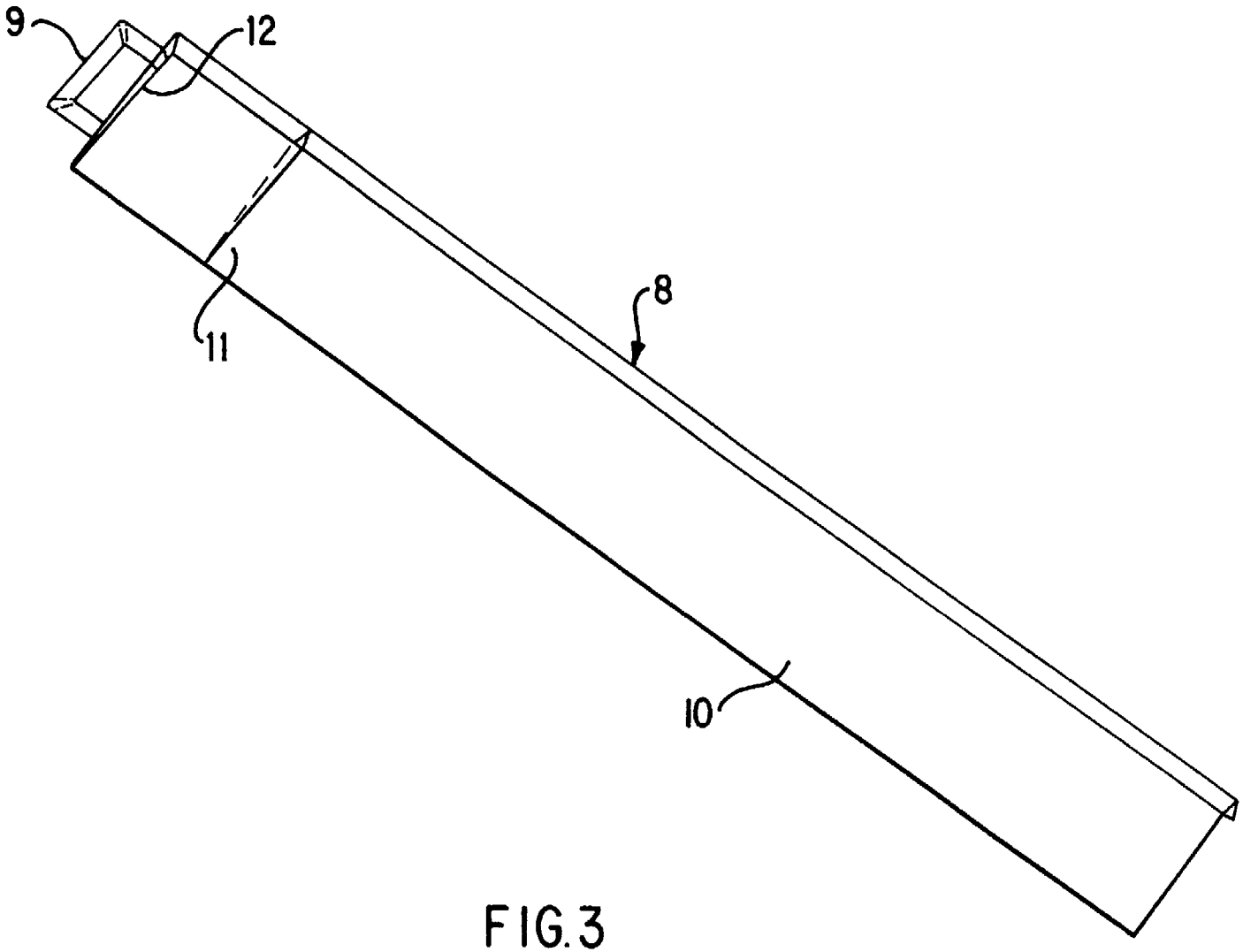
FIG. 3 is a top view of the loading assistance device according to the invention.

The special structure of the implement 8 is shown in perspective in FIG. 3. It comprises an elongated front part in the form of a chute 10 having a cylindrical portion of an angle of around 200° longitudinally enabling the modules to be held together during any movements made by the gun handler. An inner wall 11 and an outer wall 12 are fitted along one end of the chute 10, both being positioned transversally. The inner wall 11 forms a positioning means for the modules 61–66 when they are placed on the chute so that module 66, as described above, lies vertically with respect to the retaining lever 5. The wall 12 fastened at the end of the chute 10 acts as a support for the operating handle 9. The space left between the two walls is possibly blocked by a plate so as to avoid the accumulation of residues between them.

The implement 8 can either be partially or totally made of a composite material of the glass fibers type coated with epoxy resin and reinforced by a conductive material such as a metal matrix or micro-pellets of metallized glass or carbon black so as to evacuate the electrostatic charges which could initiate the modules.

Figure 4:
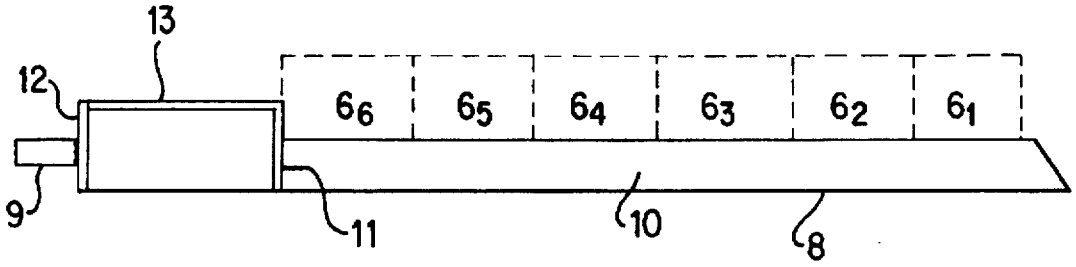
FIGS. 4 to 7 show alternative embodiments to the device according to the invention.
Figure 5:
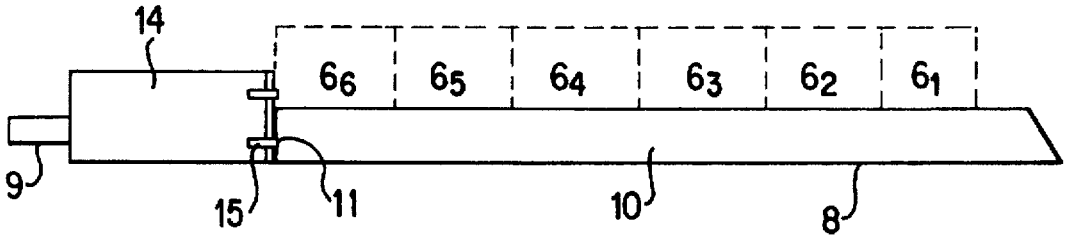

FIGS. 4 to 7 show different embodiments of implement 8. In FIG. 4, the chute 10 is represented with walls 11 and 12 connected, the walls themselves being connected by wall 13. The alternative shown in FIG. 5 shows the chute 10 to which wall 11 is connected. An element 14 is fastened to the wall 11 by fastenings 15 to support the handle 9.

Figure 6:
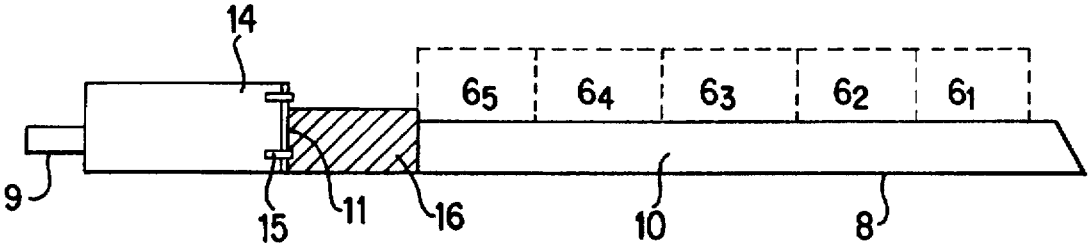
Figure 7:
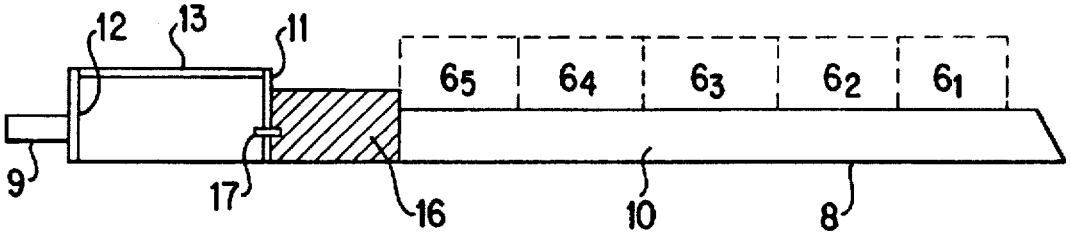

FIGS. 6 and 7 show embodiments in which the gun chamber is of a reduced length. In this event, a module 16 made of composite material is positioned and the chute 10 thus receives one to five modules 61–65. FIG. 6 shows an example where the module 16 is fastened to the chute, for example, by bonding, and the element 14 is connected as shown in FIG. 5 by fastenings 15 to the wall 11. FIG. 7 shows an example where, as shown in FIG. 4, the chute 10 is fitted with walls 11 and 12 and module 16 is connected to wall 1 by fastening 17.

We claim:

1. A device for at least one of loading and unloading a chamber of a field artillery gun with at least one of uni-modular and powder bag type charges, said device comprising an implement to carry the charges into the chamber along a longitudinal axis of the chamber, said implement being insertable into the chamber along with the charges to position the charges entirely within the chamber before firing, wherein the implement is structured to release the charges by rotating with respect to the chamber about the longitudinal axis.

2. The loading device according to claim 1, wherein the implement includes a chute having a handle and a cylindrical portion of an angle greater than 180° fitted at one end with means for positioning the charges.

3. The loading device according to claim 2, wherein the chute comprises a composite material formed of glass fibers coated with epoxy resin reinforced with a conductive material to enable the evacuation of electrostatic charges.

4. The loading device according to claim 3, wherein the conductive material includes at least one of a metallic matrix and metallized micro-pellets.

5. The device according to claim 2, wherein the positioning means is in the form of an inner wall integrated with the chute.

6. The device according to claim 5, wherein the chute includes an outer wall having an operating handle.

7. The device according to claim 5, wherein the implement includes a module made of a composite material connected to the inner wall.

8. The device according to claim 2, wherein a length of the chute of the implement is roughly equal to a length to the chamber.

9. A method for at least one of loading and unloading a chamber of a field artillery gun with charges, said method comprising the steps of:

placing the charges on an implement;

inserting the implement into the chamber along with the charges to position the charges within the chamber before firing;

rotating the implement from a position contacting the charges to a position substantially not in contact with the charges; and removing the implement from the chamber, while leaving the charges within the chamber.

10. A device for loading and unloading a chamber of a field artillery gun with at least one of uni-modular and powder bag type charges, said device comprising an implement to carry the charges into the chamber, said implement being insertable into the chamber along with the charges to position the charges entirely within the chamber before firing, said implement also being insertable into the gun chamber without the charges to unload the charges in the event of a misfire.

* * * * *